US010883488B1

(12) United States Patent
Oman et al.

(10) Patent No.: US 10,883,488 B1
(45) Date of Patent: Jan. 5, 2021

(54) SUBMERSIBLE PUMP ASSEMBLY AND METHOD FOR USE OF SAME

(71) Applicant: Texas Institute of Science, Inc., Richardson, TX (US)

(72) Inventors: Simon Oman, Ljubljana (SI); Marko Nagode, Ljubljana (SI); Jernej Klemenc, Ljubljana (SI); Franc Majdic, Ljubljana (SI); Marko Hocevar, Ljubljana (SI); Ales Gosar, Ljubljana (SI); Andrej Skrlec, Ljubljana (SI); Laslo Olah, Richardson, TX (US)

(73) Assignee: Texas Institute of Science, Inc., Richardson, TX (US)

( * ) Notice: Subject to any disclaimer, the term of this patent is extended or adjusted under 35 U.S.C. 154(b) by 0 days.

(21) Appl. No.: 16/883,719

(22) Filed: May 26, 2020

Related U.S. Application Data

(60) Provisional application No. 62/964,935, filed on Jan. 23, 2020, provisional application No. 62/961,384, filed on Jan. 15, 2020.

(51) Int. Cl.

| | |
|---|---|
| ***F04B 49/00*** | (2006.01) |
| ***F04B 23/06*** | (2006.01) |
| ***E21B 43/12*** | (2006.01) |
| ***F04B 1/14*** | (2020.01) |
| ***F04B 47/06*** | (2006.01) |

(Continued)

(52) U.S. Cl.
CPC ..... *F04B 49/007* (2013.01); *E21B 43/121* (2013.01); *F04B 1/14* (2013.01); *F04B 15/02* (2013.01); *F04B 23/06* (2013.01); *F04B 47/06* (2013.01); *F04B 49/03* (2013.01); *F04B 17/03* (2013.01)

(58) Field of Classification Search
CPC .... F04B 1/14; F04B 1/16; F04B 17/03; F04B 23/06; F04B 23/106; F04B 47/00; F04B 47/007; F04B 47/02; F04B 47/06–08; F04B 49/002; F04B 49/007; F04B 49/03–035; F04B 15/02; E21B 43/12; E21B 43/121; E21B 43/128; F04D 13/10; F04D 13/12–14; F04D 15/0072
USPC ..... 166/68, 105; 417/3, 62, 213, 216, 244, 417/246–248, 269–271, 286, 306, 426, 417/428
See application file for complete search history.

(56) References Cited

U.S. PATENT DOCUMENTS 2,194,054 A * 3/1940 Peterson ..... F04D 13/022 417/247
2,204,857 A * 6/1940 Hollander ..... F04D 13/10 417/62

(Continued)

*Primary Examiner* — Alexander B Comley
(74) *Attorney, Agent, or Firm* — Scott Griggs; Griggs Bergen LLP

(57) ABSTRACT

A submersible pump assembly for transference of a fluid medium with low viscosity is disclosed. In one embodiment, the submersible pump assembly includes multiple pump units co-axially aligned with a common drive shaft, a common suction chamber, and a common pressure chamber. Each of the pump units includes an active operational mode wherein the fluid medium is transferred from the common suction chamber to the common pressure chamber during as well as an inactive operational mode wherein the fluid medium is circulated through the common suction chamber. Each of the pump units is individually actuatable.

13 Claims, 3 Drawing Sheets

(51) Int. Cl.

| | |
|---|---|
| ***F04B 49/03*** | (2006.01) |
| ***F04B 15/02*** | (2006.01) |
| ***F04B 17/03*** | (2006.01) |

(56) References Cited

U.S. PATENT DOCUMENTS 2,431,492 A * 11/1947 Lewis ..... F04B 1/124 417/271
2,910,942 A * 11/1959 Thorman ..... F16H 61/0025 417/428
2,972,955 A * 2/1961 Richter ..... F04B 1/2021 91/486
3,306,209 A * 2/1967 Tyler ..... F04B 13/02 417/301
3,741,298 A * 6/1973 Canton ..... E21B 43/128 166/105
4,296,810 A * 10/1981 Price ..... B01D 17/085 166/106
4,303,833 A * 12/1981 Eckel ..... E03B 3/06 290/1 R
4,548,263 A * 10/1985 Woods ..... F04D 13/10 166/105
4,591,320 A 5/1986 Pope
4,861,239 A 8/1989 Simmons et al.
5,145,332 A 9/1992 Bohon
5,404,943 A * 4/1995 Strawn ..... E21B 43/121 166/105
5,456,581 A * 10/1995 Jokela ..... F04B 1/18 417/270
5,807,082 A 9/1998 Skinner et al.
5,820,354 A * 10/1998 Wild ..... F04C 2/1071 417/244
5,961,282 A * 10/1999 Wittrisch ..... E21B 43/121 415/199.6
6,056,511 A * 5/2000 Kennedy ..... E21B 43/121 417/53
6,092,599 A * 7/2000 Berry ..... E21B 43/121 166/106
6,123,149 A * 9/2000 McKinzie ..... E21B 43/121 166/106
6,173,774 B1 * 1/2001 Fox ..... E21B 43/385 166/265
6,250,390 B1 * 6/2001 Narvaez ..... E21B 43/128 166/369
6,595,295 B1 * 7/2003 Berry ..... E21B 43/128 166/105
6,598,681 B1 * 7/2003 Berry ..... E21B 43/128 166/105
6,675,902 B2 1/2004 Rowan et al.
6,811,382 B2 * 11/2004 Buchanan ..... E21B 43/128 417/244
6,904,982 B2 6/2005 Judge et al.
6,964,299 B2 * 11/2005 Scarsdale ..... E21B 43/128 166/105
7,048,057 B2 * 5/2006 Bearden ..... E21B 41/02 166/105
7,396,216 B2 * 7/2008 Blauch ..... E21B 17/206 166/369
7,736,133 B2 * 6/2010 Martinez ..... E21B 43/128 417/423.3
7,987,908 B2 8/2011 Colley, III
8,419,381 B2 * 4/2013 Ito ..... F04B 1/22 417/269
8,668,465 B2 * 3/2014 Wadsley ..... F04B 23/04 417/216
8,834,133 B2 * 9/2014 Porel ..... E21B 43/129 417/271
8,863,849 B2 10/2014 Patel
8,998,586 B2 * 4/2015 Muhs ..... F04D 9/041 417/199.2
9,045,976 B2 * 6/2015 Hallundbaek ..... E21B 43/128
9,181,785 B2 * 11/2015 Lawson ..... F04B 47/06
9,482,232 B2 * 11/2016 Andersen ..... F04D 29/628
2003/0010491 A1 1/2003 Collette
2004/0129427 A1 7/2004 Sharp
2005/0118035 A1 * 6/2005 Naito ..... F04C 25/02 417/244
2007/0022751 A1 * 2/2007 Galba ..... F16D 31/02 60/489
2013/0058800 A1 * 3/2013 Sites ..... F25J 1/0283 417/53
2014/0119965 A1 5/2014 Gabdullin
2015/0104328 A1 * 4/2015 Babbitt ..... B01D 61/08 417/2
2015/0285042 A1 * 10/2015 Porel ..... F04B 43/067 417/399

* cited by examiner

SUBMERSIBLE PUMP ASSEMBLY AND METHOD FOR USE OF SAME

PRIORITY STATEMENT & CROSS-REFERENCE TO RELATED APPLICATIONS

This application claims priority from (1) U.S. Provisional Patent Application No. 62/964,935 entitled "Submersible Pump Assembly and Method for Use of Same" and filed on Jan. 23, 2020 in the names of Simon Oman et al.; and (2) U.S. Provisional Patent Application No. 62/961,384 entitled "Submersible Pump Assembly and Method for Use of Same" and filed on Jan. 15, 2020 in the names of Simon Oman et al.; both of which are hereby incorporated by reference in entirety for all purposes.

TECHNICAL FIELD OF THE INVENTION

This invention relates, in general, to submersible pump assemblies and, in particular, to submersible pump assemblies for the removal of fluid mediums with low viscosity, such as water or light crude oil, during hydrocarbon production from a well, for example.

BACKGROUND OF THE INVENTION

Without limiting the scope of the present invention, the background will be described in relation to aging hydrocarbon producing wells where water encroachment may occur. In a healthy, optimally producing well, high pressure hydrocarbon or oil flow has the ability to lift this liquid to the surface. Over time, however, as the pressures in the formation decline and water production increases, the flow conditions change. The reservoir pressure may no longer be sufficient to unload the well such that water accumulates in the lower section of the well forming a column which further retards hydrocarbon production. Several pump-based solutions have been suggested to overcome the fluid accumulation problem and restore the flow rate of hydrocarbon producing wells. Plunger-type pump assemblies are limited by travel speed and typically operate in low pressure, lower production hydrocarbon producing wells in an advanced well life. Centrifugal-type pump assemblies are able to handle high production requests, but typically have a higher operational cost than plunger-type pump assemblies.

Further, as mentioned, over time, as the pressures in the formation decline and water production increases, the flow conditions and pressure conditions change. In existing pump assemblies, a rotational speed of a drive unit may be adjusted to compensate for the change in pressure conditions at a cost to the pump assemblies efficiency. Accordingly, there is a need for improved submersible pump assemblies and method for use of the same that efficiently operate across different hydrocarbon producing wells over the life of the hydrocarbon producing well.

SUMMARY OF THE INVENTION

It would be advantageous to achieve a submersible pump assembly and method for use of same that would improve upon existing limitations in functionality. It would also be desirable to enable a mechanical-based solution that would provide enhanced operational efficiently across different producing wells or other environments requiring the removal of fluid mediums with low viscosity, such as water or light crude oil. To better address one or more of these concerns, a submersible pump assembly and method for use of the same are disclosed. In one aspect, some embodiments include a cylinder block having cylinders and pistons. A drive shaft is rotatably supported in the cylinder block and coupled to a drive unit. An inclined leading plate is coupled to the pistons and the drive shaft such that pistons are configured to be axially driven in a reciprocating motion within the cylinders upon rotation of the inclined leading plate. A suction port and a pressure port are each located in fluid communication with the cylinders. In one operational mode, the fluid medium is transferred from the suction port to the pressure port during the reciprocating motion of the pistons, when the pistons are actively pumping. In another operational mode, the fluid medium is circulated through the suction chamber.

In another aspect, some embodiments include a submersible pump assembly for transference of a fluid medium with low viscosity is disclosed. In these embodiments, the submersible pump assembly includes multiple pump units co-axially aligned with a common drive shaft, a common suction chamber, and a common pressure chamber. Each of the pump units includes an active operational mode wherein the fluid medium is transferred from the common suction chamber to the common pressure chamber as well as an inactive operational mode wherein the fluid medium is circulated through the common suction chamber. Each of the pump units is individually actuatable.

In a still further aspect, some embodiments include multiple pump units co-axially aligned with a common drive shaft. Each of the multiple pump units is individually controllable such that the multiple pumps are serially positioned and controllable in parallel. Each of the multiple pump units include a drive shaft, which is rotatably supported in the cylinder block and coupled to a drive unit. An inclined leading plate is coupled to the pistons and the drive shaft such that pistons are configured to be axially driven in a reciprocating motion within the cylinders upon rotation of the inclined leading plate. A suction port and a pressure port are each located in fluid communication with the cylinders. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
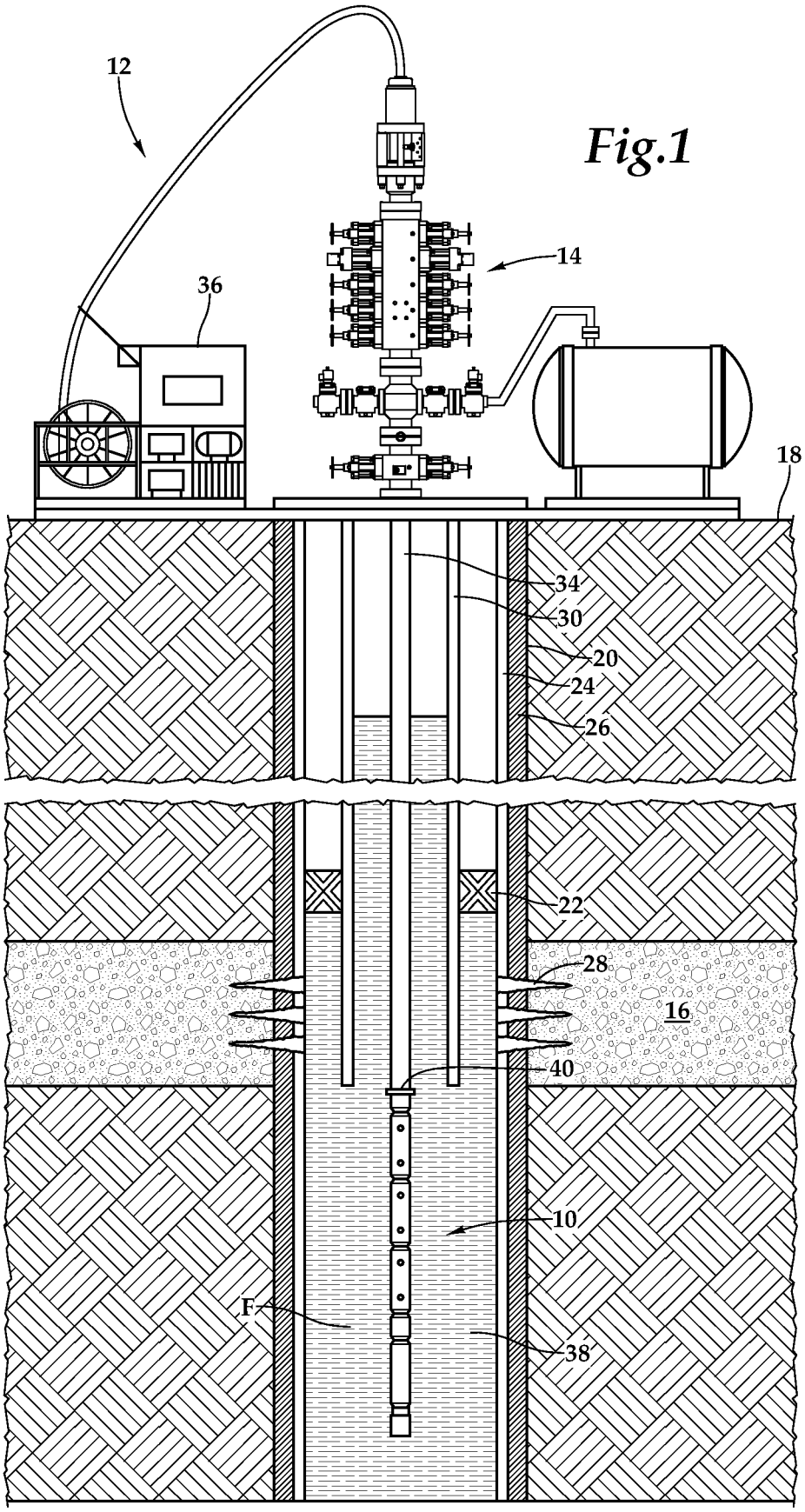
FIG. 1 is a schematic illustration depicting one embodiment of an onshore hydrocarbon production operation employing a submersible pump assembly, according to the teachings presented herein.

Referring initially to FIG. 1, therein is depicted one embodiment of a submersible pump assembly 10 being employed in an onshore hydrocarbon production operation 12, which may be producing oil, gas, or a combination thereof, for example. A wellhead 14 is positioned over a subterranean hydrocarbon formation 16, which is located below a surface 18. A wellbore 20 extends through the various earth strata including the subterranean hydrocarbon formation 16. A casing string 24 lines the wellbore 20 and the casing string 24 is cemented into place with cement 26. Perforations 28 provide fluid communication from the subterranean hydrocarbon formation 16 to the interior of the wellbore 20. A packer 22 provides a fluid seal between a production tubing 30 and the casing string 24. Composite coiled tubing 34, which is a type of production tubing 30, runs from the surface 18, wherein various surface equipment 36 is located, to a fluid accumulation zone 38 containing a fluid medium F having a low viscosity, such as hydrocarbons like oil or gas, fracture fluids, water, or a combination thereof. As shown, the submersible pump assembly 10 is coupled to a lower end 40 of the production tubing 30.

Figure 2:
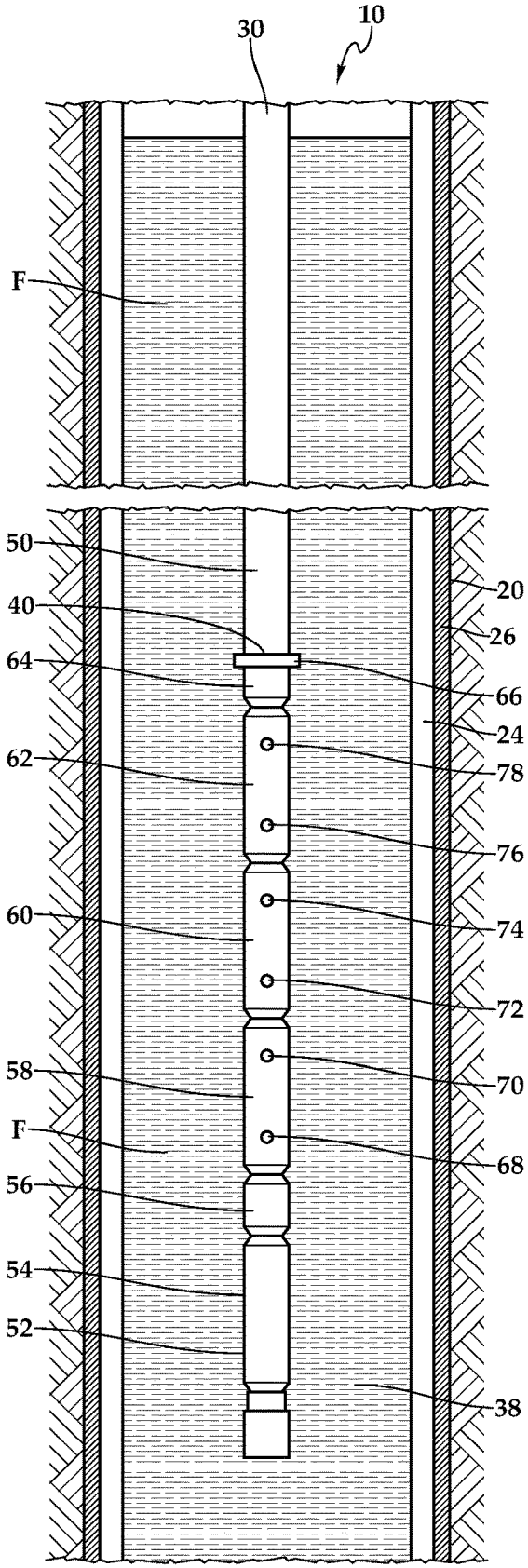
FIG. 2 is a schematic illustration depicting one embodiment of the hydrocarbon production operation of FIG. 1 in a first stage of removing a fluid medium with low viscosity.
Figure 3:
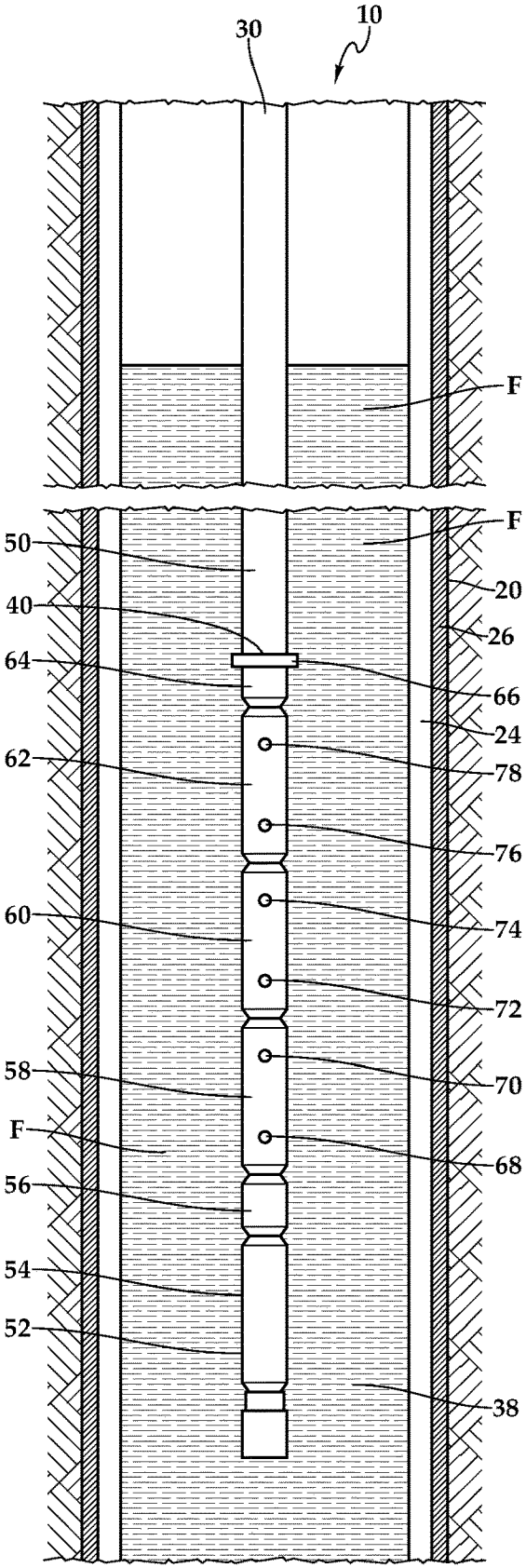
FIG. 3 is a schematic illustration depicting one embodiment of the hydrocarbon production operation of FIG. 1 in a second stage of removing a fluid medium with low viscosity.

Referring now to FIG. 2 and FIG. 3, as shown, the submersible pump assembly 10 is positioned in the fluid accumulation zone 38 defined by the casing string 24 cemented by the cement 26 within the wellbore 20. The submersible pump assembly 10 is incorporated into a downhole tool 50 connected to the lower end 40 of the production tubing 30 and, more particularly, the submersible pump assembly 10 includes a housing 52 having a drive unit 54 coupled by a coupling unit 56 to serially positioned pump units 58, 60, 62, which are, in turn, coupled to an intervention unit 64 and a connector 66. The pump unit 58 may include ports 68, 70. Similarly, the pump unit 60 may include ports 72, 74 and the pump unit 62 may include ports 76, 78. The various ports 68, 70, 72, 74, 76, 78 may be assigned various inlet or outlet functions or be sealed shut. It should be appreciated that a variety of pump unit-configurations may be employed and number of pump units, as well as ports, may vary depending on the particular application that the submersible pump assembly 10 is assigned. By way of example, in one implementation, the pump units 58, 60, 62 may share a common inlet port.

In operation, to begin the processes of transferring the fluid medium F, the submersible pump assembly 10 is positioned in the fluid accumulation zone 38. Initially, as shown best in FIG. 2, the submersible pump assembly 10 is completely submerged in the fluid medium F, which, as mentioned, may include hydrocarbons such as oil and/or gas, fracture fluid, water, or combinations thereof. The submersible pump assembly 10 is actuated and selective operation of one or more of the pump units 58, 60, 62 begins. As time progresses, as shown best in FIG. 3, the submersible pump assembly 10 pumps the fluid medium F, which may be a production fluid or a production inhibiting fluid, for example, to the surface 18. The process of pumping the fluid medium F continues until the submersible pump assembly 10 is stopped.

In some embodiments, the submersible pump assembly 10 includes modularity to provide multiple pump units in a serial arrangement in a single volume represented by the housing 52. The serial arrangement of the multiple pump units, however, provides for parallel operation with concurrent use of the pump units 58, 60, 62 to ensure redundancy. In particular, selective operation of the pump units 58, 60, 62 achieve total available low rate as well as a variable flow rate through the selective application of ON/OFF states to each of the pump units 58, 60, 62.

Figure 4:
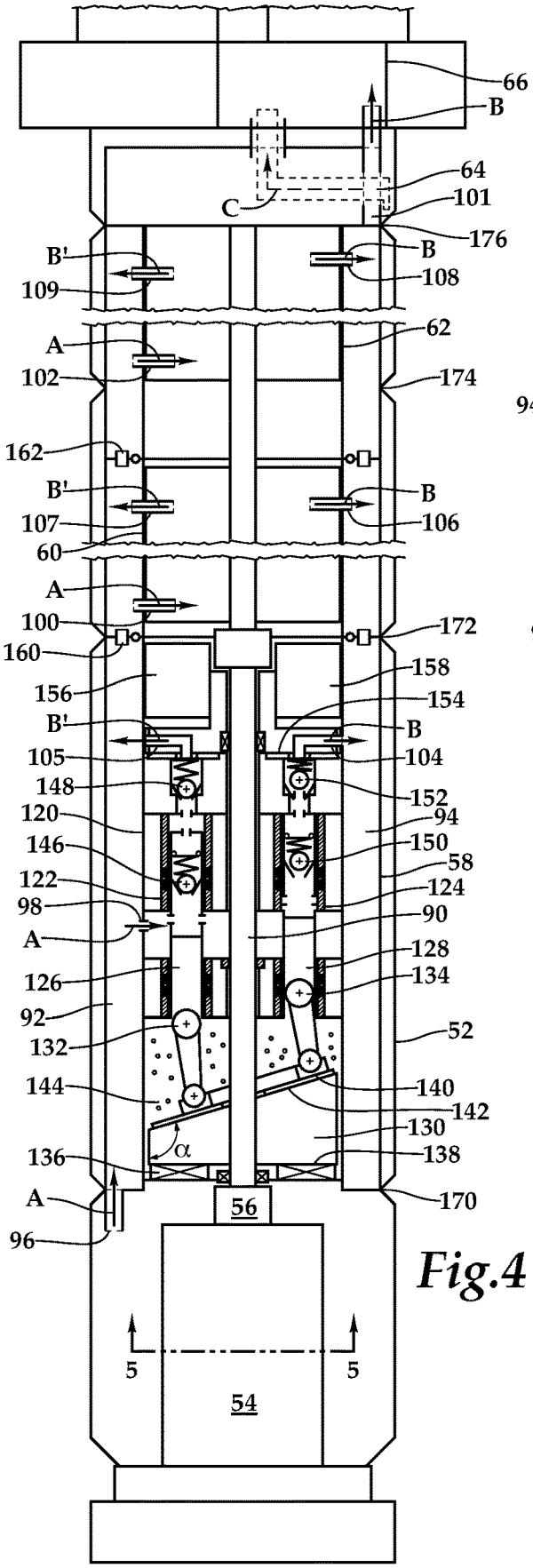
FIG. 4 is a schematic diagram depicting one embodiment of the submersible pump assembly of FIG. 1.
Figure 5:
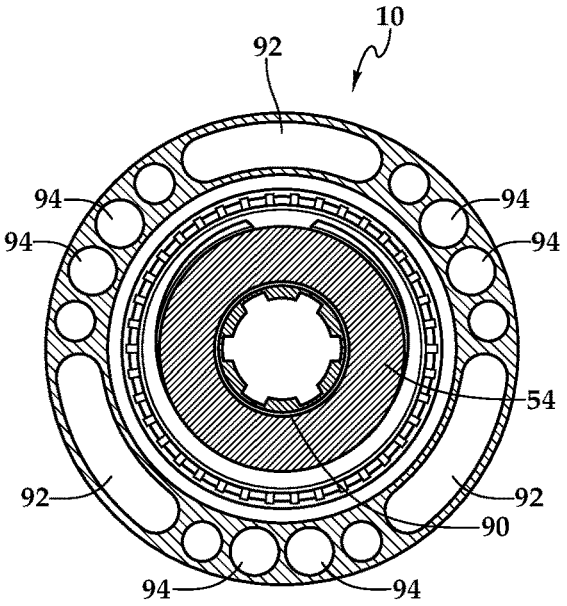
FIG. 5 is a schematic diagram depicting a cross section of the submersible pump assembly of FIG. 4 taken along line 5-5.

Referring now to FIG. 4 and FIG. 5, the submersible pump assembly 10 for transference of the fluid medium F with low viscosity is depicted in additional detail. As previously discussed, the housing 52 includes a drive unit 54 coupled by a coupling unit 56 to serially positioned pump units 58, 60, 62, which are, in turn, coupled to an intervention unit 64 and a connector 66, which, as shown, connects the submersible pump assembly 10 to the production tubing 30. The intervention unit 64 may be co-axially aligned with the pump units 58, 60, 62 and permit the fluid medium F to bypass the pump units 58, 60, 62 as shown by arrow C. The housing 52 may include housing members for each of the drive unit 54 and pump units 58, 60, 62. The pump units 58, 60, 62 are co-axially aligned with a common drive shaft 90. The common drive shaft 90 may permit each of the pump units 58, 60, 62 to have its own drive shaft section with drive shaft sections united by special shape joint couplings and driven in a serial arrangement by the drive unit 54. The common drive shaft 90 provides non-interfered power transmission to each of the pump units 58, 60, 62 via the central shaft hole for the common drive shaft 90. Each of the pump units 58, 60, 62 may be the same with respect to structure and function.

A suction chamber 92 and a pressure chamber 94 are each located in fluid communication with the pump units 58, 60, 62. The suction chamber 92 may include peripheral positioning and service each of the pump units 58, 60, 62 and provide a common suction chamber, which allows concurrent or parallel access by all of the pump units to a low pressure side of the fluid medium F being pumped. The suction chamber 92 includes an inlet port 96 with respective connection ports 98, 100, 102 to each of the pump units 58, 60, 62. The inlet port 96 may be positioned in fluid communication with port 68, for example. Each of the pump units 58, 60, 62 include respective connection ports 105, 107, 109 to the suction chamber 92. The pressure chamber 94 may also include peripheral positioning and service each of the pump units 58, 60, 62 and provide a common pressure chamber, which allows concurrent or parallel access by all of the pump units 58, 60, 62 to a high pressure side of the fluid medium F being pumped. The pressure chamber 94 includes an outlet port 101 with respective connection ports 104, 106, 108 establishing fluid communication from the pump units 58, 60, 62 to the production tubing 30 at the connector 66. The suction chamber 92 and the pressure chamber 94 provide each of the pump units 58, 60, 62 access to the fluid medium F. As all of the pump units 58, 60, 62 share the common suction chamber 92 and the common pressure chamber 94, the number of pump units 58, 60, 62 may be modified as required. That is, any number of pump units 58, 60, 62 may be employed and the number of pump units 58, 60, 62 employed will depend on the application. In one implementation, a pump unit 58, 60, 62 may be designed with respect to available fluid medium F capacity, i.e., flow that can be attained in combination with the drive unit rotational speed and the selected suction chamber cross-section. The common suction chamber 92 and the common pressure chamber 94 are peripherally positioned and the size of the common suction chamber 92 and the common pressure chamber 94 defines the maximum possible pump unit flow rate of the fluid medium F.

By way of example and not by way of limitation, with respect to the pump unit 58, a cylinder block 120 has multiple cylinders, including, for example, cylinders 122, 124, formed therein. The connection port 98 is connected to the suction chamber 92 to provide fluid communication to the cylinders 122, 124. The connection port 104 is also located in fluid communication with the cylinders 122, 124. The connection port 105 is located in fluid communication with the cylinders 122, 124 as well. A respective number of pistons 126, 128 are slidably received in each of the cylinders 122, 124 and appropriately sealed thereat. The common drive shaft 90 is rotatably supported in the cylinder block 120 and the common drive shaft 90 is coupled to, and under the power of, the drive unit 54. The cylinder block 120 is utilized to guide and support the pistons 126, 128. The cylinder block 120 may have equidistantly spaced bores serving as the cylinders 122, 124 to accept the matching pistons 126, 128. The cylinder block 120 may include low friction sliding bushings that connect the cylinder block 120 and the pistons 126, 128. Sets of seals may be appropriately positioned within the cylinder block 120. The pistons 126, 128 push the fluid medium towards the pressure chamber 94. In one implementation, each of the pistons 126, 128 have circumferentially drilled holes that supply the fluid medium to the pistons 126, 128 from the suction chamber 92.

In one implementation, an inclined leading plate 130 is coupled to the pistons 126, 128 and the common drive shaft 90. The inclined leading plate 130 includes a tilt angle alpha that is selectively adjustable. Further, the inclined leading plate 130 is coupled to the pistons 126, 128 such that the pistons 126, 128 are configured to be axially driven in a reciprocating motion within the cylinders 122, 124 upon rotation of the inclined leading plate 130. A respective number of two-ball links 132, 134 connect the inclined leading plate 130 to the pistons 126, 128. The inclined leading plate 130 is secured in place by sealing member 136 and bearing members 138 proximate an interface with the coupling unit 56. A retainer plate 140 is secured to the inclined leading plate 130 with a bearing member 142. The two-ball links 132, 134, in turn, are secured to the inclined leading plate 130 at the retainer plate 140. The two-ball links 132, 134 are designed to transfer linear, reciprocating motion from the retainer plate 140 to the pistons 126, 128. The form of the two-ball links 132, 134 may be conditioned by the kinematic motion of the retainer plate 140 and the pistons 126, 128. As shown, a lubrication subsystem 144 may be co-located with the two-ball links 132, 134. In one embodiment, the lubrication subsystem reduces the friction between the pistons 126, 128, the two-ball links 132, 134, and the inclined leading plate 130 at the retainer plate 140.

In one embodiment, the kinematic motion of the pistons 126, 128 is achieved via a properly selected geometry of the inclined leading plate 130. The angle of a contact surface with respect to the common drive shaft 90 connects the inclined leading plate 130 to the retainer plate 140 and the pistons 126, 128. Total inclination of the inclined leading plate 130 is limited by an inner diameter of the housing 52. The retainer plate 140 may be designed to hold and guide the two-ball links 132, 134 such that each of the two-ball links 132, 134 may freely rotate but still transmit axial force to the appropriate piston 126, 128. The sealing member 136 may be designed to hold wear-resistant components and sealing components that prevent the fluid medium from contacting the inclined leading plate 130. In this manner, the inclined leading plate 130 is lubricated by the lubrication subsystem 144. Many low viscosity fluids do not have sufficient lubricating properties for high-load conditions, like the conditions that may be found proximate the two-ball links 132, 134. Therefore, the sealing and lubrication components at the two-ball links 132, 134 ensure sufficient lubrication when the pump unit 58 is being utilized with low viscosity fluid mediums.

Check valves 146, 148 are serially positioned within the cylinder block 120 at the cylinder 122 to service the piston 126. Similarly, check valves 150, 152 are serially positioned within the cylinder block 120 at the cylinder 122 to service the piston 126. The check valves 150, 152 cooperate to prevent backpressure by opening during an intake stroke and closing during an exhaust stroke. A valve plate connection 154 is positioned at the cylinder block 120 and secured to a valve plate 156 actuatable by a drive member 158. The valve plate 156 may be utilized to control the flow of the fluid medium F, on a pump unit-by-pump unit basis, by rotating the valve plate 156 by a predetermined angle via the driver member 158. For example, in one embodiment, the valve plate 156 may be set to a parallel arrangement whereby the fluid medium F is permitted to flow into the pressure chamber 94 during active pumping. Alternatively, the valve plate 156 may be set to a perpendicular arrangement whereby the fluid medium F returns to the suction chamber 92, via the connection port 105, for example, with respect to the pump unit 58. It should be appreciated that the valve plate 156 includes proper sealing components to prevent any connection between the suction chamber 92 and the pressure chamber 94. By way of example, a sealing member 160 positioned at the junction between the pump unit 58 and the pump unit 60 prevents any leaking at the connection between the suction chamber 92 and the pressure chamber 94. Similarly, a sealing member 162 positioned at the junction between the pump unit 60 and the pump unit 62 also prevents any leaking at the connection between the suction chamber 92 and the pressure chamber 94. A connection assembly 170 represents the flanges, gaskets, seals, and other physical components that connect the pump unit 58 to the coupling unit 56. Similarly, a connection assembly 172 is positioned between the pump unit 58 and the pump unit 60; a connection assembly 174 is positioned between the pump unit 60 and the pump unit 62; and a connection assembly 176 is positioned between the pump unit 62 and the intervention unit 64. The housing 52 of the submersible pump assembly 10 also provides the space for communication lines, control and service lines, acquisition and data lines, and power lines. The size and positioning of these additional utilities does not diminish the strength of operation of the submersible pump assembly 10.

In an active pumping or active operational mode when the pistons 126, 128 are active, the fluid medium F is transferred from the connection port 98 at the suction chamber 92 to the connection port 104 at the pressure chamber 94 during the reciprocating motion of the pistons 126, 128. That is, the fluid medium F flows as shown by arrows A and arrows B. On the other hand, in an inactive pumping or inactive operational mode when the pistons 126, 128 are circulating the fluid medium F, the fluid medium F is transferred from the connection port 98 at the suction chamber 92 through the cylinder block 120 and out of the connection port 105 to the suction chamber 92, as shown by arrows A and arrows B'.

During active pumping, the submersible pump assembly 10 generates flow of fluid medium F by creating a positive pressure difference between the suction side at the suction chamber 92 and the pressure side at the pressure chamber 94. The pressure difference is achieved by the radial positioning of the moving pistons 126, 128 with an accompanying number of the check valve pairs, such as check valves 146, 148, 150, 152, that open and close in an alternating manner to prevent the pressurized fluid medium F from running back. That is, each of the check valves 146, 148, 150, 152 prevents backpressure by, with respect to the pistons 126, 128, opening during an intake stroke and closing during an exhaust stroke. The design of the submersible pump assembly 10 allows each pump unit 58, 60, 62 to selectively pump fluid medium F into the pressure sided at the pressure chamber 94 in an active operational mode or circulate the fluid medium F through the suction chamber 92 during an inactive operational mode when the pump units 58, 60, 62 are pumping to circulate the fluid medium F. During the inactive pumping mode, an individual pump unit 58, 60, 62 does not add anything to the total pumping flow rate since the fluid medium F is circulating to and from the suction chamber 92. In this inactive operational mode, a pump unit is not loaded and may be idle or redundant and continue in this mode of operation indefinitely.

The submersible pump assembly 10 presented herein functions to remove fluid mediums with low viscosity, such as water or light crude oil, for example. As discussed, the submersible pump assembly 10 provides for installation in confined spaces such as pipes, below or above the ground level, near or at a remote location. Optionally, the submersible pump assembly 10 may be utilized with other downhole tools, such as hydrocarbon and solid particle separators, sensors, and measuring devices, for example. Further, as discussed, any number of pump units 58, 60, 62 may be utilized in the submersible pump assembly 10 to provide redundancy as well as, through selectively actuation, calibration of the fluid medium transference required. Further, in instances of multiple pump units, like pump units 58, 60, 62, each of the pump units 58, 60, 62, may individually and selectively actuated to pump the fluid medium F from the suction chamber 92 to the pressure chamber 94 or circulate the fluid medium F through the suction chamber 92.

The order of execution or performance of the methods and techniques illustrated and described herein is not essential, unless otherwise specified. That is, elements of the methods and techniques may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A submersible pump assembly for transference of a fluid medium with low viscosity, the submersible pump assembly comprising:

a plurality of pump units having a central axis co-axially aligned with a common drive shaft;

a common suction chamber and a common pressure chamber being respectfully positioned at the periphery of the submersible pump assembly in alignment with the central axis, the common suction chamber providing the plurality of pump units concurrent and parallel access to the fluid medium under low pressure;

each of the plurality of pump units including a first operational mode wherein the fluid medium is transferred from the common suction chamber to the common pressure chamber;

each of the plurality of pump units including a second operational mode wherein the fluid medium is circulated through the common suction chamber; and each of the plurality of pump units being individually actuatable to select one of the first operational mode and the second operational mode.

2. The submersible pump assembly as recited in claim 1, wherein the submersible pump assembly forms a portion of a downhole tool.

3. The submersible pump assembly as recited in claim 1, wherein the common pressure chamber provides concurrent and parallel access for the plurality of pump units to the fluid medium under high pressure.

4. The submersible pump assembly as recited in claim 1, wherein the first operational mode further comprises active pumping of the fluid medium from the common suction chamber to the common pressure chamber.

5. The submersible pump assembly as recited in claim 1, wherein the second operational mode further comprises inactive pumping of the fluid medium with circulation of the fluid medium through the common suction chamber.

6. The submersible pump assembly as recited in claim 1, wherein the fluid medium further comprises a medium selected from the group consisting of hydrocarbons, water, and combinations thereof.

7. The submersible pump assembly as recited in claim 6, wherein the hydrocarbons further comprise oil.

8. The submersible pump assembly as recited in claim 6, wherein the hydrocarbons further comprise gas.

9. A submersible pump assembly for transference of a fluid medium with low viscosity, the submersible pump assembly comprising: a plurality of pump units having a central axis co-axially aligned with a common drive shaft; a common suction chamber and a common pressure chamber being respectfully positioned at the periphery of the submersible pump assembly in alignment with the central axis, the common suction chamber providing the plurality of pump units concurrent and parallel access to the fluid medium under low pressure, a size of the common suction chamber and the common pressure chamber defining a maximum possible flow rate of the fluid medium; each of the plurality of pump units including a first operational mode wherein the fluid medium is transferred from the common suction chamber to the common pressure chamber; each of the plurality of pump units including a second operational mode wherein the fluid medium is circulated through the common suction chamber; and each of the plurality of pump units being individually actuatable to select one of the first operational mode and the second operational mode.

10. The submersible pump assembly as recited in claim 9, wherein the common pressure chamber provides concurrent and parallel access for the plurality of pump units to the fluid medium under high pressure.

11. The submersible pump assembly as recited in claim 9, wherein the first operational mode further comprises active pumping of the fluid medium from the common suction chamber to the common pressure chamber.

12. The submersible pump assembly as recited in claim 9, wherein the second operational mode further comprises inactive pumping of the fluid medium with circulation of the fluid medium through the common suction chamber.

13. A submersible pump assembly for transference of a fluid medium with low viscosity, the submersible pump assembly comprising: a plurality of pump units having a central axis co-axially aligned with a common drive shaft; a common suction chamber and a common pressure chamber—being respectfully positioned at the periphery of the submersible pump assembly in alignment with the central axis, the common suction chamber providing the plurality of pump units concurrent and parallel access to the fluid medium under low pressure, a size of the common suction chamber and the common pressure chamber defining a maximum possible flow rate of the fluid medium; each of the plurality of pump units comprising: a cylinder block having a plurality of cylinders formed therein; a first port located in fluid communication with the plurality of cylinders and the common suction chamber; a second port located in fluid communication with the plurality of cylinders and the common pressure chamber; a third port located in fluid communication with the plurality of cylinders and the common suction chamber; a plurality of pistons slidably received in the plurality of cylinders; the common drive shaft being rotatably supported in the cylinder block, the common drive shaft being coupled to a drive unit; an inclined leading plate coupled to the plurality of pistons and the drive shaft, a tilt angle of the inclined leading plate is selectively adjustable, the inclined leading plate coupled to the plurality of pistons such that the plurality of pistons are configured to be axially driven in a reciprocating motion within the plurality of cylinders upon rotation of the inclined leading plate; and a plurality of two-ball links connecting the inclined leading plate to the plurality of pistons; each of the plurality of pump units including a first operational mode wherein the fluid medium is transferred from the common suction chamber to the common pressure chamber during; each of the plurality of pump units including a second operational mode wherein the fluid medium is circulated through the common suction chamber; and each of the plurality of pump units being individually actuatable for to select one of the first operational mode and the second operational mode.

* * * * *